United States Patent [19]

Harjapää

[11] 4,026,444

[45] May 31, 1977

[54] APPARATUS FOR FOLDING AND PRESSING GARMENTS

[75] Inventor: Osmo Viljam Harjapää, Boras, Sweden

[73] Assignee: AB Calator, Boras, Sweden

[22] Filed: Sept. 20, 1976

[21] Appl. No.: 724,878

[30] Foreign Application Priority Data

Sept. 19, 1975 Germany ..... 7529713[U]

[52] U.S. Cl. ..... 223/37

[51] Int. Cl.[2] ..... A41H 33/00

[58] Field of Search ..... 223/1, 37, 70, 38; 270/64, 66, 86, 93, 94, 67, 83–85; 53/117

[56] References Cited

UNITED STATES PATENTS

| | | | |
|---|---|---|---|
| 3,057,133 | 10/1962 | Gayring et al. | 53/117 |
| 3,167,223 | 1/1965 | Weiss | 223/37 |
| 3,269,619 | 8/1966 | Freeman | 223/37 |

*Primary Examiner*—G. V. Larkin

*Attorney, Agent, or Firm*—Pollock, Vande Sande & Priddy

[57] ABSTRACT

Apparatus for folding and pressing garments such as shirts includes a heated base plate for supporting the garment on its front or bodice; a holding plate hingedly attached to the collar end of the base plate; a center plate arranged at the tail end of the base plate and adapted to be moved above and over the base plate; a stripper plate hingedly attached to the tail end of said center plate; and side plates arranged at different levels above and along the sides of the base plate and center plate and adapted to fold the side portions of the garment over the center portion thereof supported by the base plate and center plate.

23 Claims, 12 Drawing Figures

3
45
44
10
5
30
6
7
1
2
27
30
4
28
12
12
8
30
30
9
- 38 -
- 38 -
- 38 -
18
19
33
18
19

44
3
5
11
6
13
7
8
4
47
9

APPARATUS FOR FOLDING AND PRESSING GARMENTS

BACKGROUND AND OBJECTS OF THE INVENTION

Machines have already been developed for folding and pressing simple articles such as towels, which are relatively easily and quickly foldable thanks to their rectangular shape. However, these machines are completely unsuitable for folding and pressing articles of more complicated shape such as shirts and blouses.

An object of the invention is to provide an apparatus for folding and pressing garments such as shirts and blouses in a quick and simple operation.

Another object is to provide such an apparatus which may be easily controlled by a single operator and is safe and reliable in use.

These objects are given only by way of example. Thus, other desirable objects and advantages inherently achieved by the invention may occur to those skilled in the art. Nonetheless, the scope of the invention is to be limited only by the appended claims.

SUMMARY OF THE INVENTION

The above and other objects are achieved in accordance with the invention, which includes a stationary frame having a stationary base plate mounted therein. A first plate is pivotably mounted adjacent to the end of the base plate at which the garment collar will rest in use and a second plate is movably mounted at the opposite end of the base plate in position to support the tail portion of the garment. The second plate is arranged for movement up and over the base plate to a superposed position, so that the garment tail is folded toward its collar. Side plates arranged beside the base plate and second plate serve to fold the sides of the garment toward its center. A third plate is pivotably mounted to the second plate to hold the tail of the garment during folding.

BRIEF DESCRIPTION OF THE DRAWINGS

Further characteristics and advantages of the invention appear from the following specification with reference to the accompanying drawings, in which.

DETAILED DESCRIPTION OF THE PREFERRED EMBODIMENT

Figure 1:
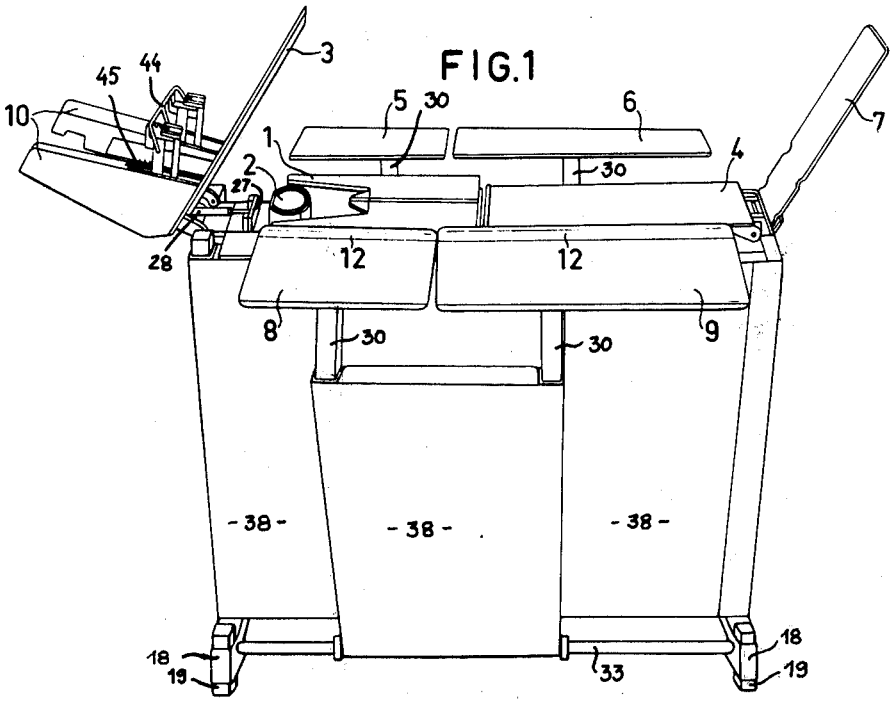
FIG. 1 shows a perspective view of a preferred embodiment of an apparatus for folding and pressing according to the present invention.

With reference to FIGS. 1 to 7, the apparatus according to the invention is provided with folding and pressing plates 1 and 3 to 9. Plate 1 preferably is arranged in a stationary, horizontal position; whereas, plates 3 and 7 are swingable about or in relation to a horizontal axis. Plates 5, 6 and 8, 9 are arranged approximately horizontally on opposite sides of plate 1 and 4 and can be horizontally displaced in pairs towards one another. Plate 7 can be swung about the outer or tail end of plate 4. A collar expander 2 is provided, in the conventional location at the collar end of plate 1. Fastener devices 10 are arranged at the head or collar end of the apparatus to fasten together the completely folded shirt by means such as staples.

Plate 7 is preferably from one to several centimeters narrower than plate 4 and about 10 centimeters shorter; so that when plate 7 has been swung down above plate 4, it ends about 10 centimeters from the inner front edge of plate 4.

Figure 2:
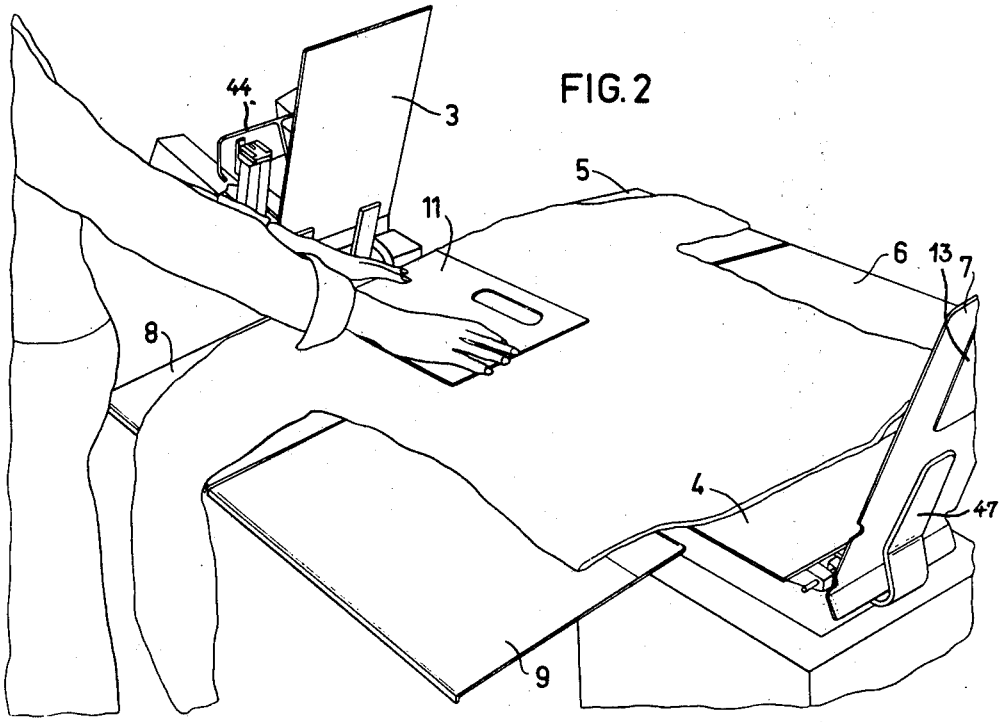
FIGS. 2–7 show diverse phases of operation and working positions at the apparatus according to FIG. 1 from the initial phase of laying out a buttoned, unfolded shirt to the final phase of removing the shirt folded and ready for wrapping for sale.

On the apparatus according to the invention, a buttoned shirt or blouse is laid with the front or bodice side facing downward on plates 1 and 4 as shown in FIG. 2. The collar of the garment is placed around collar expander 2, which extends up into the collar. A sheet of cardboard 11 or the like then is laid on the backside of the shirt. Usually sheet 11 is secured in place with a protrusion (not shown) which is inserted underneath the collar of the garment. Collar expander 2 then is actuated to hold the shirt and expand the collar to its full size. Alternatively, collar expander 2 may be actuated first and sheet 11 laid on afterward.

Figure 3:
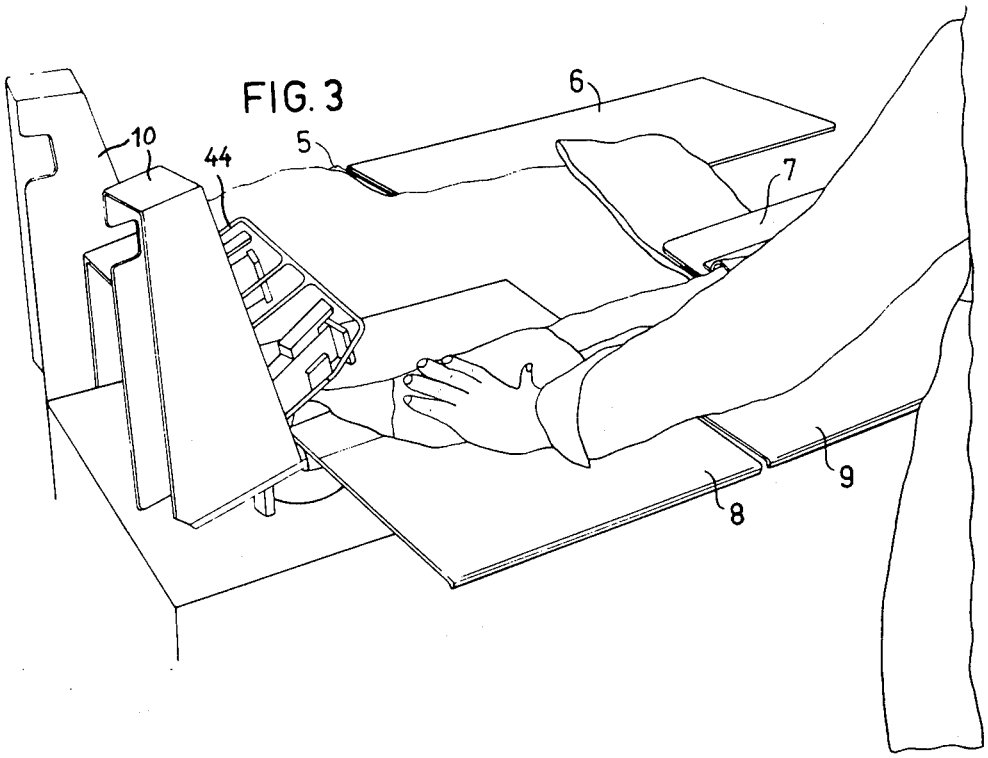

From this point, the operator can proceed in various ways depending on how the shirt is to be folded. In one method, the operator folds one sleeve along sheet 11 toward the tail of the garment so that the cuff initially lies toward the tail and later is folded up toward the collar. In another method, the operator places the one sleeve upon the other sleeve which has been folded inward across sheet 11 so that the folded garment does not have any visible cuff. After the sleeves and cuffs are folded in one of these ways, about 10 centimeters of the tail end of the shirt is folded toward the collar onto the remaining part of the shirt, as indicated in FIG. 3. Then plate 3 is swung down to clamp the previously folded portions of the garment, sheet 11, and the rest of the shirt firmly between itself and plate 1. Now plate 7 is swung down to firmly clamp the lower or tail portion of the shirt, along with the strip that has been folded toward the collar.

Plates 8 and 9 are moved simultaneously inward above plates 1, 4, 3 and 7. Due to this movement, the left part of the shirt is folded between plates 8 and 9 and plates 1 and 4. Plates 5 and 6 then move simultaneously inward above plates 8 and 9. This movement folds the right part of the shirt between plates 5 and 6 and plates 8 and 9. To facilitate this movement, plates 1 and 4 are arranged at the lowermost level. with plates 8 and 9 at a somewhat higher one and plates 5 and 6 at the highest. The control circuitry of the apparatus is preferably such that the downward movement of plate 7 actuates a micro-switch 7*a* (FIG. 8) which closes a circuit to actuate pneumatic or hydraulic cylinders (See FIGS. 8 and 9), which automatically push in first plates 8 and 9 and then plates 5 and 6. Sequential movement of the plates is regarded as the most advantageous method; however, alternatively, all of the side plates can be moved inward simultaneously.

Figure 4:
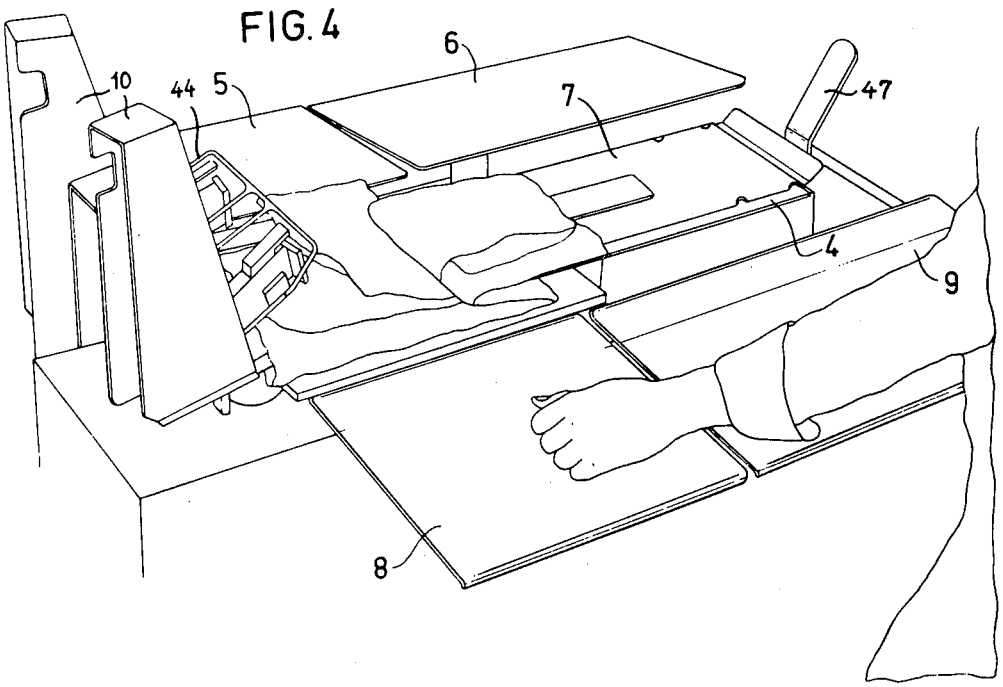
Figure 5:
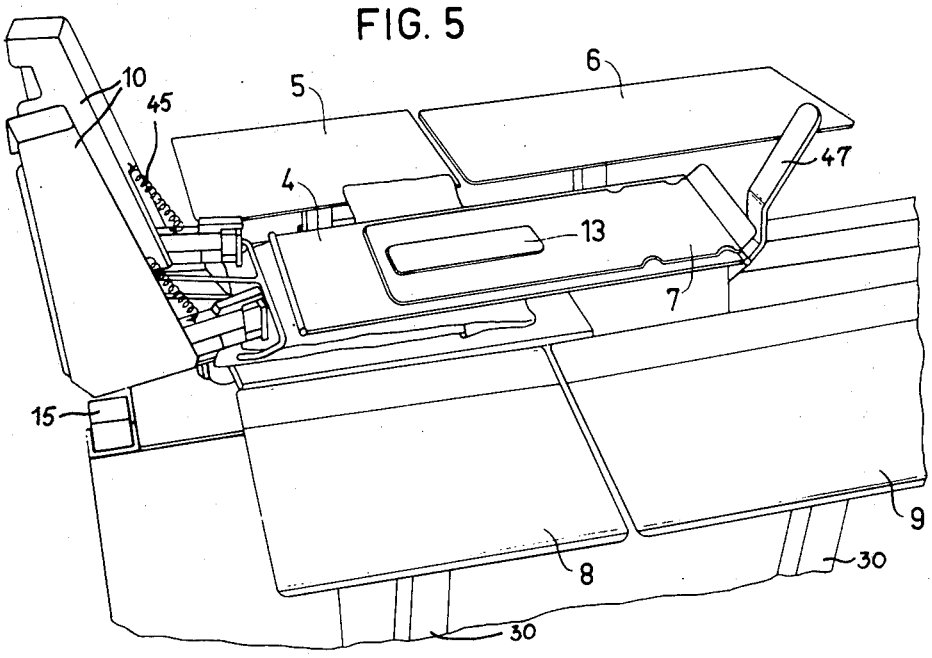
Figure 6:
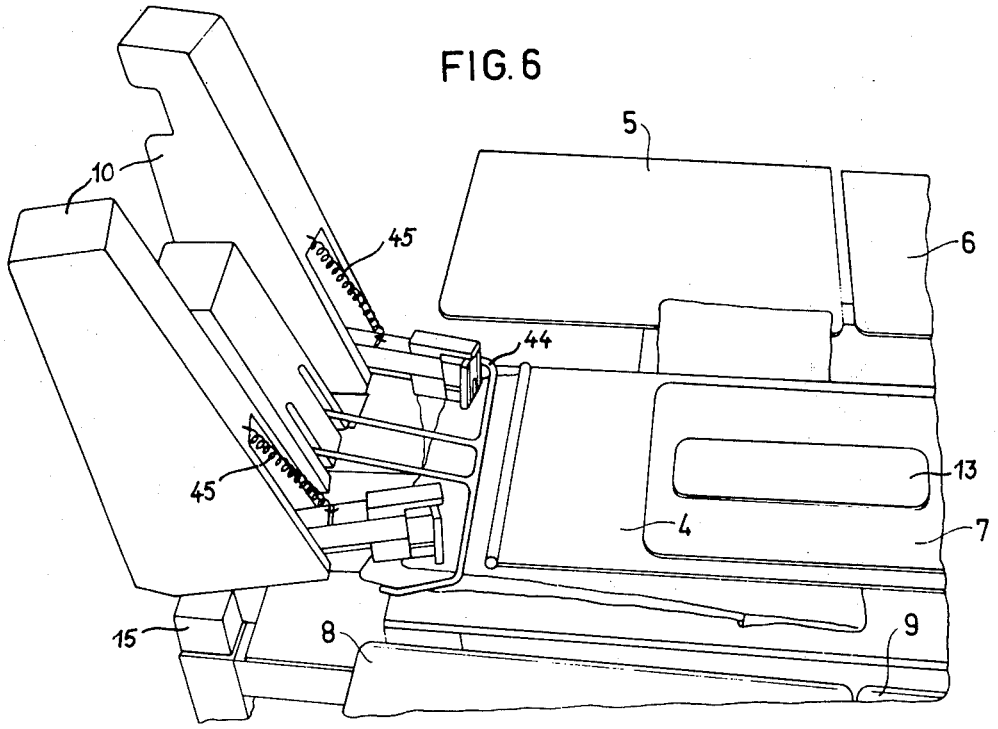

The control circuitry is further arranged so that following the previously described movement, all of the side plates are moved outward to their outermost positions, preferably simultaneously. Thereafter plates 4 and 7 are raised a few centimeters, which can occur in the form of a diagonal movement which is directed forward and upward in relation to plate 1. The shirt lies with its lower or tail portion resting in part upon plate 4 and in part folded around plate 7 as shown in FIG. 4. After attaining their uppermost position, plates 4 and 7 are pushed further forward over plate 3 whereby the part of the shirt surrounding plate 7 gradually slides off of this plate and finally slides over the foremost edge of plate 4, which is provided with a laterally extending lip or bulge on its foremost edge. The entire shirt is now folded completely as shown in FIG. 5. Before plate 4 begins its withdrawal movement and while it still holds the completely folded shirt in place as shown in FIG. 5, fastener devices 10 mounted on plate 3 are actuated to automatically drive a staple through each folded corner portion of the shirt outside the collar. Fastener devices 10 slip into the shirt with a tongue (not shown) as the shirt rests on plate 3 and are actuated by a pneumatic cylinder (not shown). Between fastener devices 10 on plate 3 there is provided a protective grid 44 which is swung down onto the folded shirt in the position shown in FIGS. 5 and 6 prior to actuating fastener devices 10 by a pneumatic cylinder (not shown). Grid 44 attains in its swung down position a distance from plate 1 somewhat less than finger thickness before fastener devices 10 can be actuated. If there is an obstacle such as the operator's hand, the relatively raised position of grid 44 is used to prevent fastener devices 10 from actuating. Tension springs 45 automatically lift up fastener devices 10 and keep them in an upper position. The power of said springs can only be overcome when fastener devices 10 are actuated. After plates 4 and 7 have completed their function at the collar end of the apparatus, they are moved back to their former positions. During this movement plate 7 is swung upward about axis 52 (FIG. 8) to return to its initial position as shown in FIG. 1 so that plate 7 preferably assumes an angle of about 120° with plate 4. Support 47 holds plate 7 in te desired position. In the final phase of this movement, plate 4 is guided so that it is lowered in a diagonal, downward and outward movement to the level of plate 1.

Figure 7:
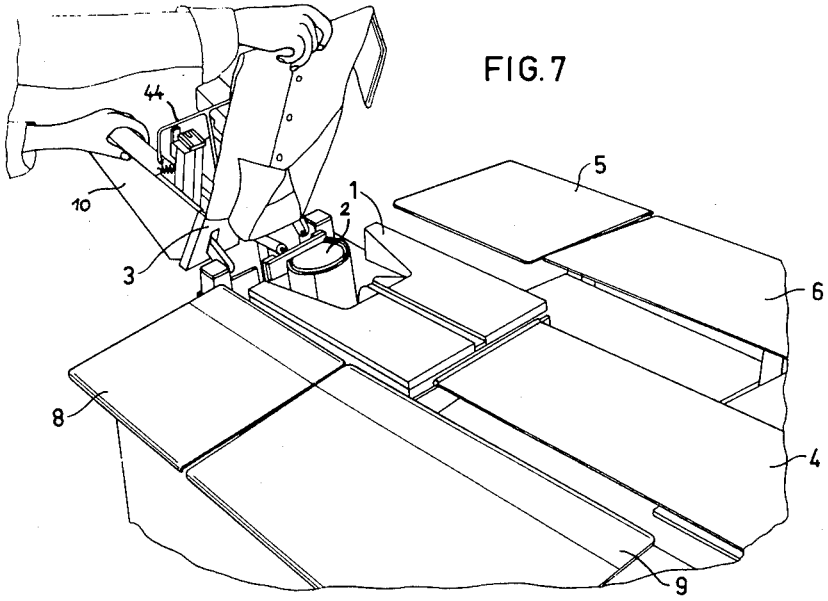
Figure 8:
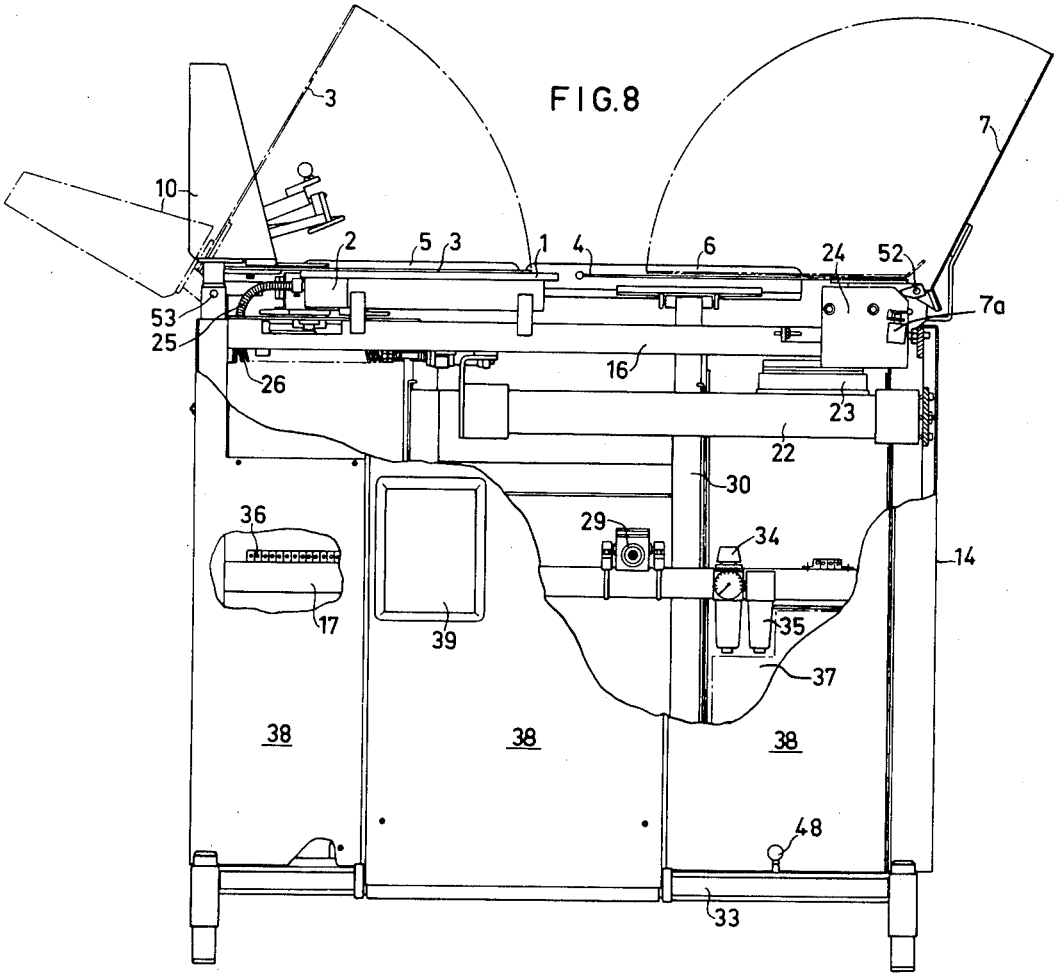
FIG. 8 shows a side elevation view, partially broken away, of the apparatus according to FIG. 1.

Finally, plate 3 is manually or automatically swung up about axis 53 to the position shown in FIGS. 7 and 8 thereby raising the completed folded shirt to a locaion convenient for removal. Plate 3 preferably is stopped at an angle of about 70° with the plate 1. The operator can now remove the shirt, which is completely folded and fastened together, from plate 3 leaving the apparatus ready for the next operation.

As shown in FIG. 1, a friction strip 12 is attached along the leading edges of plates 8 and 9 preferably at an approximate distance of one half centimeter from each inner longitudinal edge. Strips 12 preferably are about 5 cm. wide. A self-adhering strip made of fabric and/or plastic material with a roughened upper surface having relatively high frictional resistance is preferred. While plates 8 and 9 are drawn out of the folded shirt, these strips 12 function to stretch the shirt somewhat in a lateral direction. Plate 7 can also be provided on its external side on the outer half with a friction strip 13, which is about 5 cm. wide and at about 5 cm. distance from the longitudinal sides and with an approximate distance of 1 cm. from the plate's free front edge. The strip can be about 15 cm. Strip 13 functions to stretch the shirt somewhat in a longitudinal direction as plates 4 and 7 move toward the collar.

Plates 5, 6, and 8, 9 are arranged so that they can be adjusted within limits in suspensions provided about their external longitudinal edges. See FIG. 9. The plates also are adjustable in the vertical direction and may be secured in the desired orientation. This serves chiefly for adaptation of these plates to various material thicknesses and types of materials. There are for example relatively thick types of textiles, which require a higher adjustment of the plates. Plates 5, 6 and 8, 9 alternatively can be united in one single longitudinal plate on each respective side. The apparatus should preferably be somewhat inclined toward the operator, for example at an angle of about 10°–20°, in order to allow a more comfortable working position.

If it is desired for esthetic purposes to have one cuff visible at the front or back, only the opposite sleeve is folded, for example the left, over sheet 11, so that the right sleeve extends somewhat beyond and above plate 5. After that the folding procedure as previously described follows during which the right sleeve remains outside of plate 5. Then the manual folding of the right sleeve follows so that one part is folded inward and folded back again, so that the cuff itself comes to lie outside the folded shirt as indicated in FIG. 7. After that plates 4 and 7 are pushed inward over plates 1 and 3, whereby the cuff extends out of the folded shirt and said cuff can then by way of choice be folded forward in order to lie on the folded shirt, or it can be folded back, in order to lie behind the completely folded shirt. Both cuffs can also be made visible.

Figure 9:
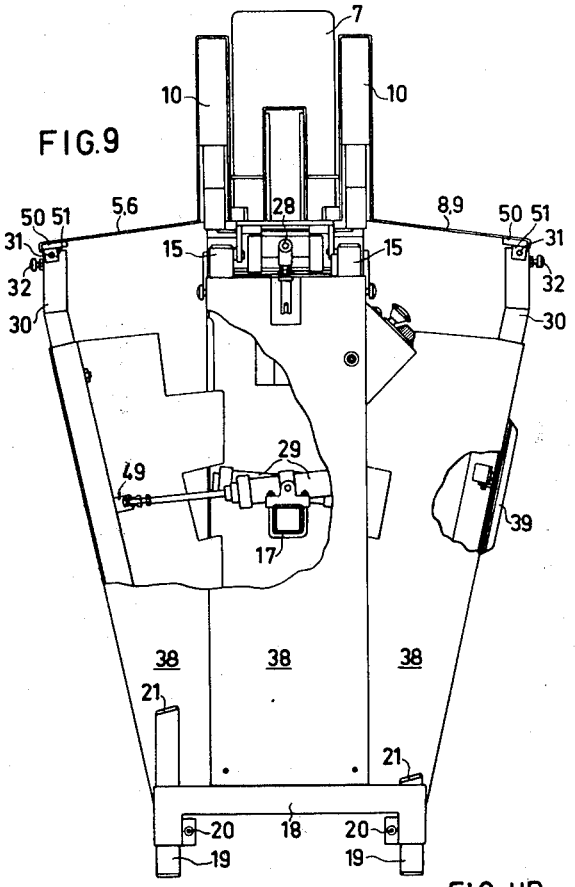
FIG. 9 shows a left end elevation view, partially broken away, of the apparatus according to FIG. 8.
Figure 10:
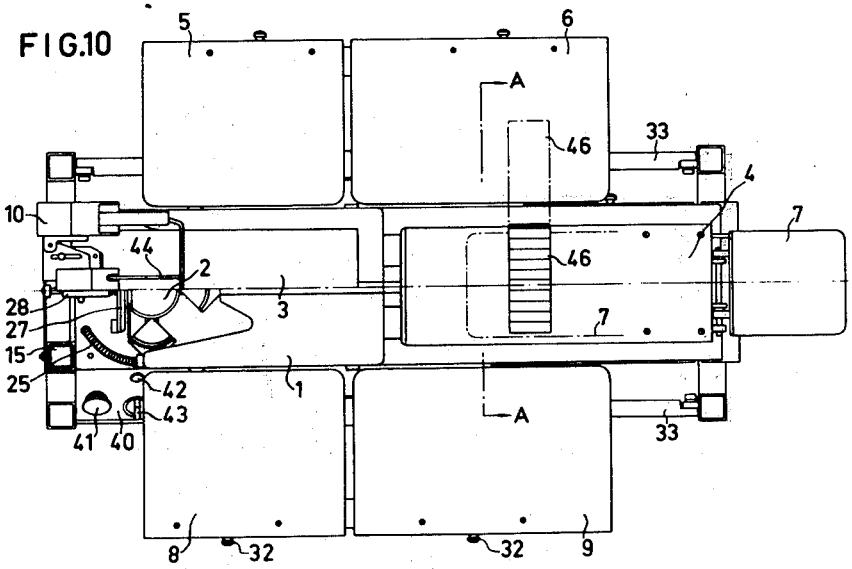
FIG. 10 shows a top view partially broken away, of the apparatus according to FIG. 8 and 9.

The foregoing describes the function of the elements of the invention which actually control the garment. FIGS. 8 to 11 reveal in greater detail the interior construction of the apparatus shown in FIGS. 1–7. As shown in FIGS. 8 to 10, the apparatus comprises a frame 14 having at each a pair of spaced vertical struts 15 connected at their upper ends by a longitudinally extending pair of tubular bearing elements 16. Approximately centrally of the apparatus, a beam 17 extends in longitudinal direction between struts 15. Struts 15 are interconnected near their lower ends by horizontal traverses 18 provided with feet 19. Feet 19 can be made of elongated tubes or the like adapted to be slidable in the vertical direction and securable by means of arresting screws 20. At one long side of said apparatus feet 19 can be longer than at the other, as shown in FIG. 9 to enable inclination of the apparatus in working position. To provide a stable support when the device is inclined in used, the foot ends 21 can be somewhat oblique. Preferably during transport feet 19 are inserted upside down as shown from FIG. 9 to be reversed at the place of installation, so that the oblique ends 21 are facing the floor.

Below tubular bearing elements 16, a hydraulic or pneumatic cylinder 22 is mounted longitudinally. The upper side of cylinder 22 is provided with a longitudinal slot (not shown) out of which protrudes a carrier 23 connected to the cylinder piston. Carrier 23 horizontally adjustably supports a slider 24 to which plates 4 and 7 are attached. Plate 4 and thus slider 24 are guided so that starting from the position shown in FIGS. 1 and 8, a movement of plate 4 is obtained which is inclined upwards and toward collar expander 2, in relation to plate 1. This movement can be achieved, for example, by means of corresponding oblique, guide rails or grooves (not shown) extending upward toward collar expander 2 into which extend guide pins mounted on plate 4 and/or slider 24.

Bearing elements 16 also support base plate 1 which includes a heating element powered via wiring 25. Bearing elements 16 further support collar expander 2, which may comprise three different parts as shown schematically in FIG. 10, whereby a pressure spring 26 and additional mechanism (not shown) having a pneumatic cylinder are used to actuate collar expander 2. There can also be arranged an element 27 movable toward and away from collar expander 2 by a pneumatic cylinder 28, which serves to hold shirt collars and the inserted protrusions of stiffening sheets 11.

Beam 17 supports hydraulic or pneumatic cylinders 29 which are operatively connected via joints 49 to supporting bars 30, at the upper ends of which plates 5, 6 and 8, 9 are suspended. Axles 31 and arresting screws 32 permit limited adjustment of the plate for the purposes previously discussed. Border plates 50 and bearing 51 facilitate such adjustment. There are all together four support bars 30 each supporting one of plates 5, 6, 8 or 9. The lower ends of bars 30 are swingable about lower axles 33 extending in longitudinal direction of the apparatus between the ends of transverse members 19.

Beam 17 carries also a manometer 34 for controlling incoming pressurized air for diverse devices driven by such air as pneumatic cylinders and a receptacle 35 for lubricating substance, which via various passages (not shown) is fed to points requiring lubrication. FIG. 8 reveals also a clamp strip 36 for electrical wiring and a control unit 37, which can be located lower-most in the apparatus.

All sides of the apparatus preferably are covered by several protection plates 38, the vertical edges of one of which are secured to struts 30 on each longitudinal side of the apparatus, so that the plate is movable with the struts. Arresting screws 48 secure the plates to the frame.

On the side of the apparatus where an operator is to stand, a so-called knee control 39 can be provided on the movable plate 38, to be actuated by the operator to initiate a folding operation. To the left of knee control 39, the stationary part of the apparatus can provide a keyboard 40 with emergency stop 41, control lamp 42 and thermostatic hand-wheel 43 for choice of temperature of said heatable plate1.

Figure 11A:
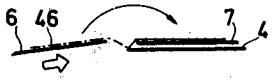
FIGS. 11A and 11B illustrate schematically the mode of operation of a special folding and retaining element shown in FIG. 10.
Figure 11B:
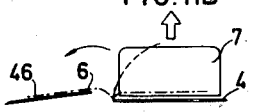

FIG. 10 and 11 show a special folding and retaining element 46, which comprises a relatively wide elastic belt made up of a plurality of thin and narrow plates which are elastically interconnected across said belt. Element 46 is secured with one end to one long side of plate 4. As shown in FIG. 11A, in the initial position said element 46 rests upon e.g. plate 6. When plate 6 is pushed in over plates 4 and 7, element 46 is folded in and rests upon that shirt part which is superposing plate 7, thereby retaining and securing this part of the shirt. When plate 7 during its reverse movement is lifted up to its upper position, element 46 is folded outwards and thrown backwards to its initial position on plate 6. Such a folding and retaining element guarantees to a high extent an exact folding position for shirts and retaining of them in a desired position. The element 46 can naturally have another shape such as a hinge-like one or as a throughout flexible belt of the like.

The embodiments described in the foregoing and shown in the drawings are to be regarded as non-limiting examples, which can be altered and completed in any way within the scope of the invention.

Having described my invention in sufficient detail to enable those skilled in the art to make and use it, I claim:

1. Apparatus for folding and pressing garments such as shirts, comprising:

a stationary frame;

a stationary base plate mounted in said frame for supporting the garment, said base plate having a first end located to be near the collar end of a garment, a second end spaced from said first end and located to be toward the tail end of a garment, and spaced longitudinal sides extending between said ends;

a first movable plate pivotably associated with said frame adjacent to said first end for holding a garment on said base plate;

a second movable plate located within said frame adjacent to said second end for supporting the tail portion of a garment;

means for moving said second plate to a first position superposing said first plate to fold the tail portion of a garment toward its collar and returning said second plate to a second position essentially aligned with said base plate;

third and fourth movable plates pivotably associated with said frame along respective ones of said longitudinal sides, said third and fourth plates being located above said base plate, for folding side portions of a garment toward its center; and a holding means removably associated with said second movable plate for holding the tail portion of a garment thereon.

2. Apparatus according to claim 1, wherein said third and fourth plates are located at different levels above said base plate to permit their simultaneous movement toward the center of a garment.

3. Apparatus according to claim 1, wherein said holding means comprises a heavy flexible belt swingably arranged on one longitudinal side of said second plate.

4. Apparatus according to claim 3, wherein said holding means further comprises a fifth plate pivotably associated with said second plate at its end opposite said second end of said stationary plate, said heavy flexible belt located to be moved to overlie said second plate when said third and fourth plates fold the side portions of a garment toward its center.

5. Apparatus according to claim 1, wherein said holding means comprises a heavy hinge-like element swingably arranged on one longitudinal side of said second plate.

6. Apparatus according to claim 5, wherein said holding means further comprises a fifth plae pivotably associated with said second plate at its end opposite said second end of said stationary plate, said hinge-like element being located to be moved to overlie said second plate when said third and fourth plates fold the side portions of a garment toward its center.

7. Apparatus according to claim 1, wherein said holding means comprises a fifth plate pivotably associated with said second plate at its end opposite said second end of said stationary plate, for holding the tail portion of a garment.

8. Apparatus according to claim 7, wherein said fifth plate is narrower and shorter then said second plate.

9. Apparatus according to claim 7, further comprising means for moving said third and fourth plates toward the center of the garment to fold its side portions, in reposnse to movement of said fifth plate into position above said second plate for holding garment.

10. Apparatus according to claim 7, wherein said fifth plate is adapted to return to an upright position approximately 120° from said second plate when said second plate has returned to its second position.

11. Apparatus according to claim 7, wherein said fifth plate comprises a friction strip on its uppermost surface when said fifth plate is holding the tail portion of a garment.

12. Apparatus according to claim 1, wherein said first plate is adapted to move between a first position folded down above said base plate and a second position raised at an angle above said base plate.

13. Apparatus according to claim 1, further comprising means mounted for pivotable movement with said first plate for fastening a folded garment by means such as staples.

14. Apparatus according to claim 1, wherein said means for moving said second plate is actuated following movement of said third and fourth plates to strip the tail portion of the garment from said second plate and fold it over the portion of the garment held on said stationary plate.

15. Apparatus according to claim 1, wherein said means for moving said second plate causes said second plate to follow an obliquely upward path as it moves to superpose said base plate.

16. Apparatus according to claim 1, wherein said second plate comprises leading edge having a laterally extending bulge or lip.

17. Apparatus according to claim 1, wherein said first movable plate is adapted to be rotated away from said base plate to raise a folded garment for removal from the apparatus.

18. Apparatus according to claim 1, wherein at least one of said third and fourth plates is provided with a friction strip along its upper surface near its leading edge.

19. Apparatus according to claim 18, wherein said at least one plate is arranged below the other.

20. Apparatus according to claim 1, further comprising means for adjusting the height of said third and fourth plates relative to said base plate and for rotating said plates about a longitudinal axis in said frame.

21. Apparatus according to claim 1, wherein said plates are inclined at an angle of about 15° to 20° from the horizontal to facilitate use.

22. Apparatus according to claim 1, wherein said third and fourth plates are mounted on support bars pivotably attached to longitudinally extending axles located in the lower portion of the apparatus.

23. Apparatus according to claim 1, further comprising support elements attached to said frame, said support elements comprising vertically adjustable elongated support feet having on one end support surface oriented obliquely to the vertical, so that by supporting the apparatus on one or the other ends of said feet, it may be positioned in an inclined or a vertical position.

* * * * *